US007273590B2

(12) United States Patent
Yao et al.

(10) Patent No.: US 7,273,590 B2
(45) Date of Patent: Sep. 25, 2007

(54) GRAVITY-DRIVEN APPARATUS AND METHOD FOR CONTROL OF MICROFLUIDIC DEVICES

(75) Inventors: Nan-Kuang Yao, Taoyuan (TW); Jhy-Wen Wu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 6 days.

(21) Appl. No.: 10/836,011

(22) Filed: Apr. 29, 2004

(65) Prior Publication Data

US 2005/0255004 A1 Nov. 17, 2005

(51) Int. Cl.
*B01L 3/02* (2006.01)

(52) U.S. Cl. ..... 422/100; 422/130; 422/58

(58) Field of Classification Search ..... 422/100, 422/58, 106, 130; 435/288.4, 288.5
See application file for complete search history.

(56) References Cited

U.S. PATENT DOCUMENTS

2002/0142471 A1 10/2002 Handique et al. ..... 436/53
2002/0150683 A1* 10/2002 Troian et al. ..... 427/256
2003/0150733 A1 8/2003 Ramsey ..... 204/600

* cited by examiner

*Primary Examiner*—Jill Warden
*Assistant Examiner*—Natalia Levkovich

(57) ABSTRACT

A gravity-driven apparatus and method control the flow order of reactants in microfluidic devices which are employed in a microfluidic chip. The gravity-driven apparatus flow order control mainly comprises a plurality of reactant chambers arranged at different heights, a plurality of flow-control microchannels, and a reaction chamber having a winding collection microchannel. Each reactant chamber has an air-in vent. Each pair of neighboring flow-control microchannels has a U-shaped structure connecting the pair of neighboring flow-control microchannels. To activate the microfluidic device, the device is placed in an inclining or standing position and the air-in vents are unsealed. This apparatus enhances the reliability of flow order control for multiple reactants. It can be built in a microfluidic chip, and does not use any actuating power or element. Therefore, it is low in energy-consumption, low in manufacturing cost and free of pollution.

8 Claims, 7 Drawing Sheets

GRAVITY-DRIVEN APPARATUS AND METHOD FOR CONTROL OF MICROFLUIDIC DEVICES

FIELD OF THE INVENTION

The present invention generally relates to an apparatus and method for controlling microfluidic devices, and more specifically to a gravity-driven apparatus and method for controlling the flow order of reactants in microfluidic devices.

BACKGROUND OF THE INVENTION

Flow order control is the basis of automatic reaction process for most biochemical analyses. The significant function requirements of flow order control include (1) the capability to switch the flow of three to five reactants, (2) correctly following the flow order of three to five reactants, (3) the capability to define and control the flow amount of three to five reactants, and (4) the capability to minimize the mixing of any two reactants with successive flow orders during the flow order control. The flow order control of multiple reactants therefore becomes the key to the automatic biochemical analysis of microfluidic chips. In the design of microfluidic chips, flow order control belongs to the high level combinational function that often requires a serial of accompanying components to perform. Thereby in a system, it may include the elements of micro electromechanical system (MEMS), such as a micropump, a plurality of microvalves, an infrastructure of microchannels, a flow amount detector, microflow switches, and a pressure differential actuator etc.. The failure or defect of any element will cause the failure of the entire reaction process. Therefore, the manufacture difficulty is relatively high.

Furthermore, it requires more peripheral supporting electromechanical facilities, and such a requirement is a deviation from the design principle of an on-site, disposable and fast bio-medical test kit of microfluidic chips. It is therefore necessary to develop a flow order control device which does not use any power source, movable valves, and peripheral supporting electromechanical facilities to overcome the aforementioned disadvantages.

The literature survey shows that very few elements can provide the high level flow order control function. Most of prior arts focus on changing the microfluidic direction. In 1992, Doring et. al. (Proc. IEEE Micro Electro Mechanical System Workshop, 1992) used the direction that drives the deformation of the hanging arm via thermal expansion to switch the moving fluid direction. The moving fluid would be guided along the tail of the hanging arm into one of the two outlet chambers because of the Coanda effect. This is shown in FIG. 1.

Handique et. al. (U.S. Patent Publication 2002/0,142,471) disclosed a method of using gas actuators to provide pressure to the moving fluid in order to generate driving force. Valves are placed inbetween two gas actuators and used to separate the gas actuators. When multiple actuators are used, an infrastructure of microchannels is constructed. Ramsey (U.S. Patent Publication 2003/0,150,733) disclosed a method of using electro osmotic flow or capillary electrophoresis to drive DNA, and then using the voltage change to guide the separated DNA into different channels.

Prior art related to flow order control devices are numerous. However, most of them require not only very complicate chip fabrication process but also more peripheral supporting electromechanical facilities. It is important that such a flow order control device should be low in energy-consumption, low in manufacturing cost and free-of-pollution.

SUMMARY OF THE INVENTION

This invention has been made to achieve the advantages of a practical flow order control device. The primary object is to provide a gravity-driven apparatus for flow order control employed in a microfluidic chip.

The gravity-driven flow order control apparatus mainly comprises a plurality of reactant chambers arranged at different heights, a plurality of flow-control microchannels, and a reaction chamber having a collection microchannel with a winding shape. Each reactant chamber has an air-in vent. Each separate flow-control microchannel is connected to the bottom of its corresponding reactant chamber, and each pair of neighboring separate microchannels has a U-shape structure connecting the pair of neighboring separate microchannels. These separate microchannels are converged into the reaction chamber through the collection microchannel.

It is another object of the invention to provide a gravity-driven flow order control method. The method mainly comprises the steps of: (a) placing a plurality of reactants into the plurality of reactant chambers arranged at different heights, (b) using the air-in vent and the long and separate microchannels to accomplish the vent control required for switching flow of the reactants, (c) using moving microfluid as air-out vent to form a continuous U-shaped structure with air-out vents arranged at different heights, and (d) using the continuous U-shaped structure to accomplish the settings of flow order and timing for activating the reactants.

According to the invention, the reactants are initially stored in reactant chambers and each air-in vent is sealed. To activate the microfluidic chip, the chip is placed in an inclining or standing position and the air-in vents are unsealed. The fluidic reactants flow along separate microchannels. Due to the design of separate microchannels, a reactant flows from a reactant chamber through a corresponding separate microchannel into the collection microchannel in the order specified by the height of the position of the reactant chamber. The minimal mixing of reactants before entering the collection microchannel can be achieved due to the air lock effect.

The gravity-driven flow order control apparatus does not use any activating power or peripheral supporting electromechanical facilities. It can be built in a microfluidic chip without moving parts. Therefore it is low in energy-consumption, low in manufacturing cost and free-of-pollution.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
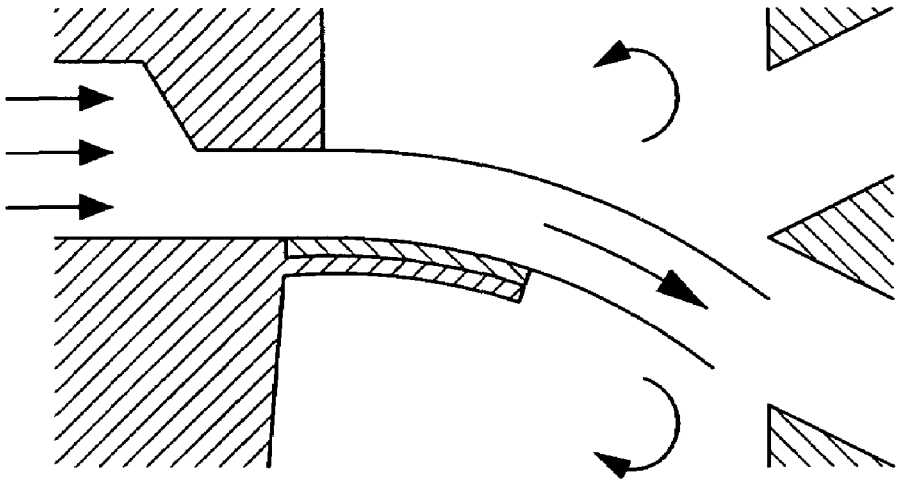
FIG. 1 (PRIOR ART)
FIG. 1 shows a prior art that changes the microfluidic direction to provide flow order control of microfluidic devices.
Figure 2:
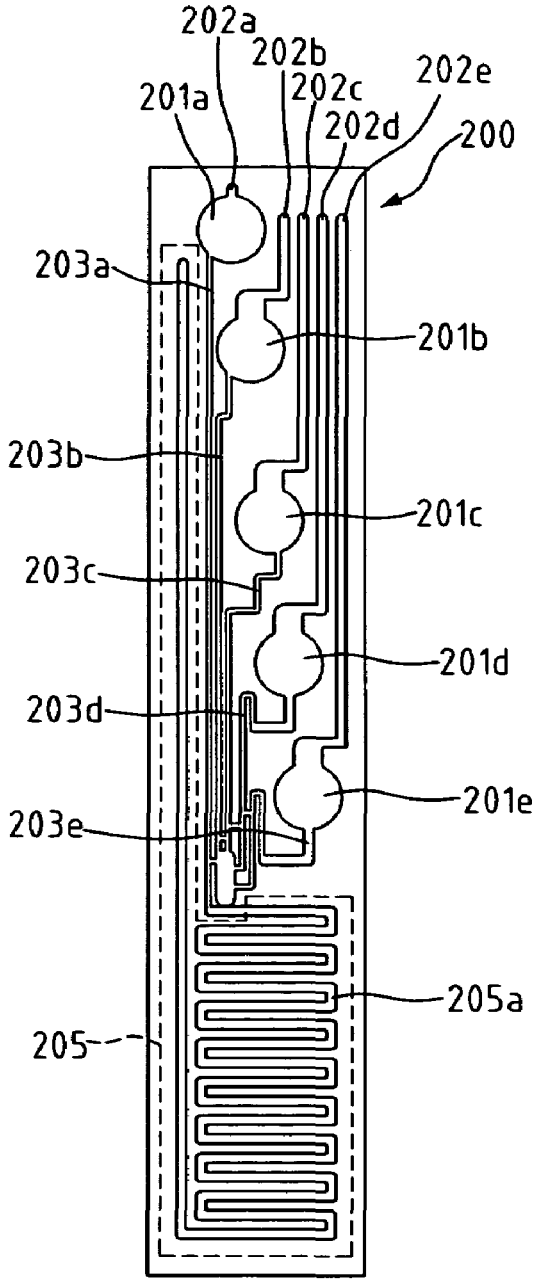
FIG. 2 shows a schematic view of a gravity-driven flow order control apparatus employed in a microfluidic chip according to the present invention.

FIG. 2 shows a schematic view of a gravity-driven flow order control apparatus employed in a microfluidic chip according to the present invention. Referring to FIG. 2, the gravity-driven flow order control apparatus employed in the microfluidic chip 200 comprises a plurality of reactant chambers 201*a*~201*e* arranged at different heights, a plurality of flow-control microchannels 203*a*~203*e*, and a reaction chamber 205 having a collection microchannel 205*a* with a winding shape. This embodiment takes five reactant chambers and separate microchannels as an example. Each reactant chamber has an air-in vent. Five air-in vents are referred to as 203*a*~202*e*. Each separate microchannel is connected to the bottom of its associated reactant chamber, and each pair of neighboring separate microchannels has a side connection channel connecting the pair of microchannels. The upper parts of each pair of flow-control microchannels and the side connection channel together form a U-shape structure connecting the pair of neighboring separate microchannels. These separate microchannels are converged into the reaction chamber 205 through the collection microchannel 205*a*. The side connection channels are positioned in a step-wise pattern at different distances from the collection microchannel of the reaction chamber.

Initially, five reactants (not shown) are respectively stored in the reactant chambers 201*a*~201*e* and air-in vents 202*a*~202*e* are sealed. When the microfluidic chip 200 is placed in an inclining or standing position and the air-in vents are unsealed, the five fluidic reactants respectively flow downward due to the gravity. Due to the structure of flow-control microchannels 203*a*~203*e*, the reactants respectively flow from the reactant chambers 201*a*~201*e* through their corresponding separate microchannels 203*a*~203*e* into the collection microchannel 205*a* in the order specified by the heights of the positions of the reactant chambers.

The minimal mixing of reactants before entering the collection microchannel 205*a* can be achieved due to the air lock effect. A number of features are included in the present invention to guarantee the reactants will flow in the order specified by the heights of the positions of the reactant chambers (i.e. from top to bottom). A detailed description for these features will be provided in the following paragraphs.

Figure 3:
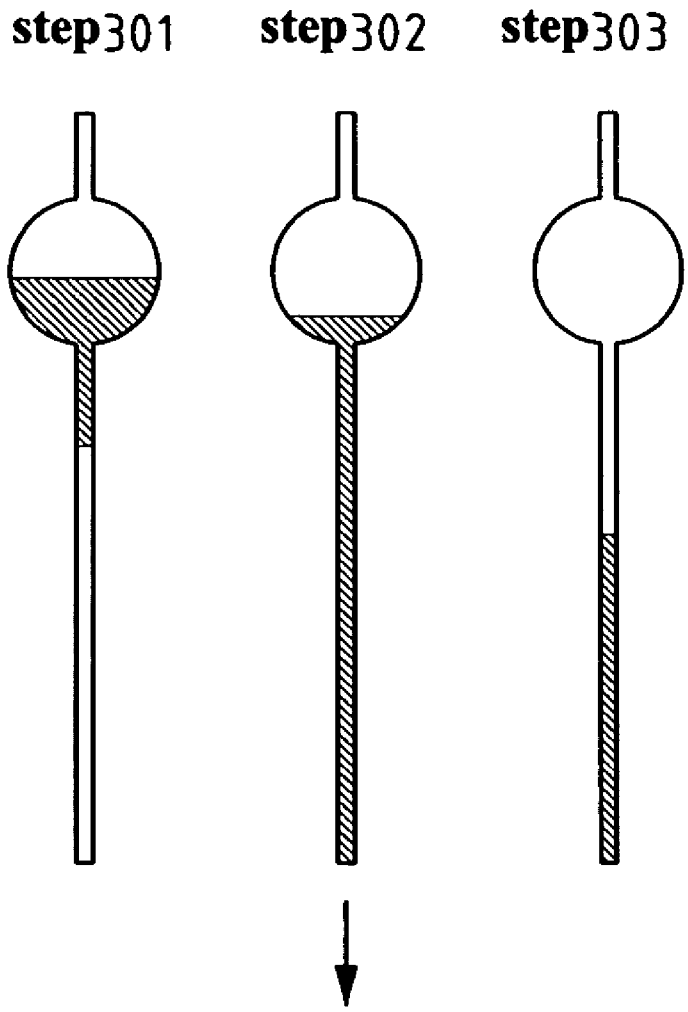
FIG. 3 shows the air-in-lock effect which can effectively block the flow of a microfluid.

The flow of a microfluid in a microchannel depends on whether the air in front of the microfluid can be expelled and the air behind the microfluid can be injected. Therefore, the use of an air vent is important in controlling the flow of a microfluid. In order to control the flow order, each air vent is designed to operate in a first-opened-then-closed manner in the invention. At first, the air vent is opened to activate the flow of a microfluid. Then, the air vent is closed to block the passage to air. The closure of an air vent can effectively form a closed valve for the fluids in other separate microchannel. FIG. 3 shows the air-in-lock effect which can effectively block the flow of a microfluid.

As shown in FIG. 3, the operation for an air vent includes the following three steps. In step 301, an air-in vent is opened and the fluid flows down its corresponding separate microchannel. In step 302, the fluid fills the long microchannel and creates increasing resistance for further flowing due to the increasing surface contact with the side wall of the microchannel, However, the height of the fluid still provides enough pressure for flowing. In step 303, when most of the fluid has flown into the collection microchannel, the height of the fluid is too low to provide enough pressure, thereby failing to overcome the resistance for further flowing. Thus the flow stops and the air vent can be regarded as in a closed status. In other words, this invention uses the long and separate microchannels as the air vents to accomplish the air vent control required for switching flow of the reactants.

Figure 4:
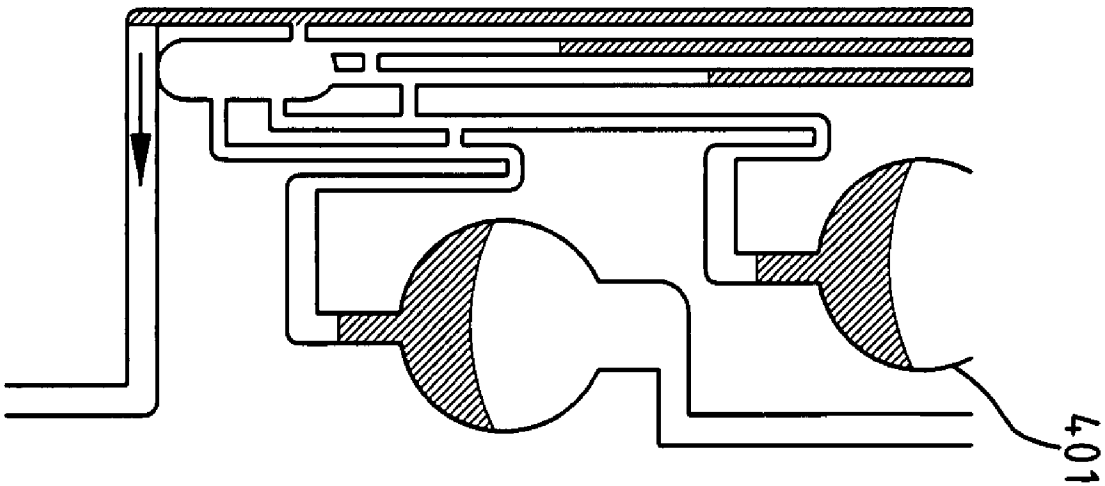
FIG. 4 shows how the air-out-lock effect caused by the flow of a prior fluid can effectively block the flow of successive fluids.

FIG. 4 shows how the air-out-lock effect caused by the flow of a prior fluid can effectively block the flow of successive fluids. As shown in FIG. 4, when the fluid in the highest reactant chamber not shown in the figure and connecting to the leftmost microchannel starts to flow down, the fluid blocks the air at the bottom of the other separate microchannels. The reason is the fluid in the highest reactant chamber has the highest potential and the lowest flow resistance. The blockage of the air at the bottom prevents the fluids in the other separate microchannels and reactant chambers 401 from further flowing, while keeping a U-shaped structure formed at the bottom of the flowing separate microchannel and the neighboring separate microchannel filled with fluids. The filling of the U-shape structure with the fluids sets the stage for the next step of flow order control. In other words, this invention uses moving microfluid as air vent to form a continuous U-shaped structure arranged at different heights.

Figure 5:
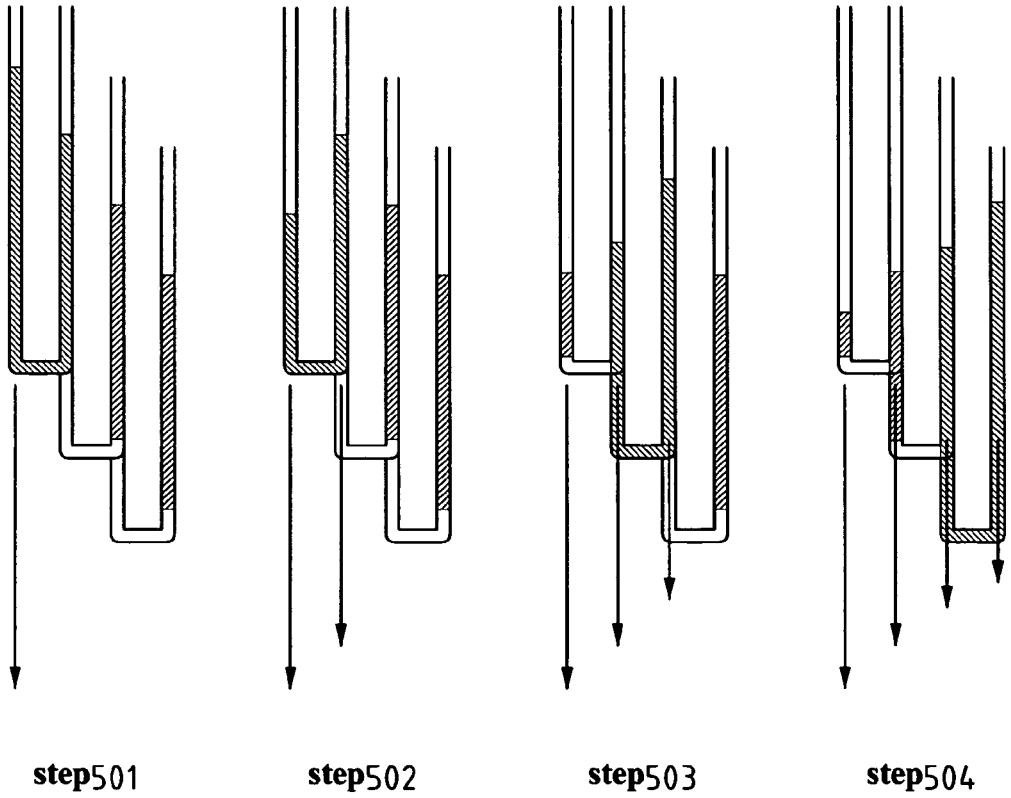
FIG. 5 shows the continuous U-shaped structure at the bottom of the separate microchannels of FIG. 2.

As illustrated in FIG. 2, each side connection channel is perpendicular to the two adjacent flow-control microchannels being connected by the side connection channel. A U-shaped structure is therefore formed with a bottom being a side connection channel and two arms being the upper parts of the two adjacent flow-control microchannels as illustrated in FIG. 5. It should be noted that any two adjacent side connection channels are only connected through the flow-control microchannels instead of being directly connected to each other. FIG. 5 shows the continuous U-shaped structure formed by at each pair of neighboring flow-control microchannels with a U-shaped structure connected to a next U-shaped structure at a lower position. The U-shaped structure is also arranged at a different height, in respect of the position of the connected reactant chamber. In a U-shaped channel, the fluid in both arms of the U-shaped channel has the same height when open to air due to the balanced air pressure on the two arms. This characteristic of a U-shaped channel is utilized in the present invention. In FIG. 5, three U-shaped channels are connected and partially overlapped through the flow-control microchannels with bottoms of the U-shaped structures positioned at different heights.

As illustrated in FIG. 2, each side connection channel is perpendicular to the two adjacent flow-control microchannels being connected by the side connection channel. A U-shaped structure is therefore formed with a bottom being a side connection channel and two arms being the upper parts of the two adjacent flow-control microchannels as illustrated in FIG. 5. It should be noted that any two adjacent side connection channels are only connected through the flow-control microchannels instead of being directly connected to each other. FIG. 5 shows the continuous U-shaped structure formed by each pair of neighboring flow-control microchannels with a U-shaped structure connected to a next U-shaped structure at a lower position. The U-shaped structure is also arranged at a different height, in respect of the position of the connected reactant chamber. In a U-shaped channel, the fluid in both arms of the U-shaped channel has the same height when open to air due to the balanced air pressure on the two arms. This characteristic of a U-shaped channel is utilized in the present invention. In FIG. 5, three U-shaped channels are connected and partially overlapped through the flow-control microchannels with bottoms of the U-shaped structures positioned at different heights.

The followings illustrate the four steps of using the continuous U-shaped structure to accomplish the settings of flow order and timing for activating the reactants. In step 501, the heights of the fluid in each separate microchannel are initially different and decreasing from left to right, thereby with the leftmost being the highest. In step 502, the fluid in the leftmost separate microchannel, being the highest, flows down further along the separate microchannel until the height of the fluid is lower than the height of the fluid in the right neighboring separate microchannel. At this point, the height of the fluid in the second separate microchannel becomes the highest. In step 503, the fluid in the second separate microchannel flows down further along the corresponding separate microchannel until the height of the fluid is lower than the height of the fluid in the right neighboring separate microchannel. In step 504, the same situation will repeat for the rest of the separate microchannels.

The geometric arrangement of the continuous U-shaped structure allows the fluids in the separate microchannels to flow in the order of the height of the fluid. In other words, this invention uses the continuous U-shaped structure to accomplish the flow order control for multiple reactants. It is worth noting that only fluid being the highest can flow at one time, while the others are being blocked. This also prevents the non-selected reactants from flowing downward at the same time.

From the foregoing description, specially for FIGS. 3-5, the method for flow order control of microfluidic devices according to the invention mainly comprises the steps of: (a) placing a plurality of reactants (microfluids) into the plurality of reactant chambers arranged at different heights, (b) using the long and separate microchannels as the air vents to accomplish the air-in vent control required for switching flow of the reactants, (c) using moving microfluid as air-out vent to form a continuous U-shaped structure arranged at a different height, and (d) using the continuous U-shaped structure to accomplish the settings of flow order and timing for activating the reactants.

The followings describe other features, substitutions, and advantages of the present invention with appropriate reference to the accompanying drawings.

Figure 6:
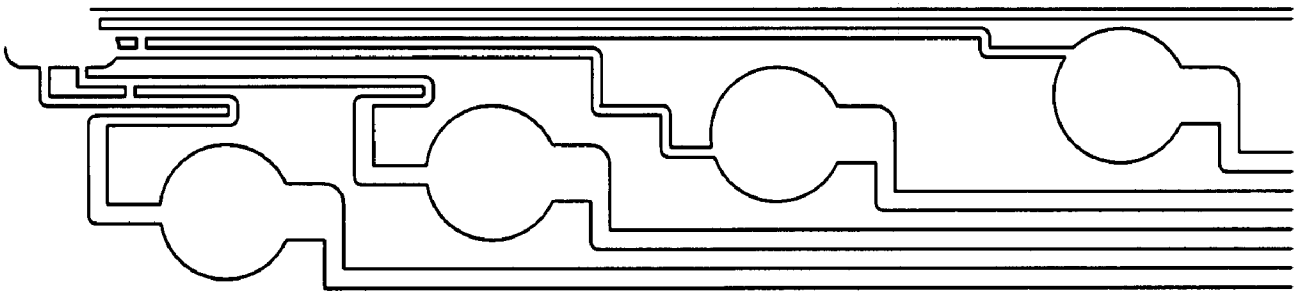
FIG. 6 shows a further geometric arrangement for increasing the flow resistance of reactants.

FIG. 6 shows a further geometric arrangement for increasing the flow resistance of reactants, including using different diameters and different lengths for the different separate microchannels, using the long and short distances for the different separate microchannels, and using the ratio of an upward flowing segment in the separate microchannels during flowing. Such geometric structures may guarantee each reactant be correctly guided into the reaction chamber in a specified order, and prevent the fluids in the reactant chambers from being pre-maturely activated to flow due to the transportation or capillary phenomenon for the microfluidic chip. For example, the separate microchannels of the reactant chambers may have bent segments as shown in FIG. 6 for providing different flow resistance. The microchannels may have U-turns. The bent segments in the microchannels may also have different lengths. In other words, this invention uses the geometric structure arrangement for increasing the flow resistance of reactants to enhance the reliability of flow order control for multiple reactants.

Figure 7:
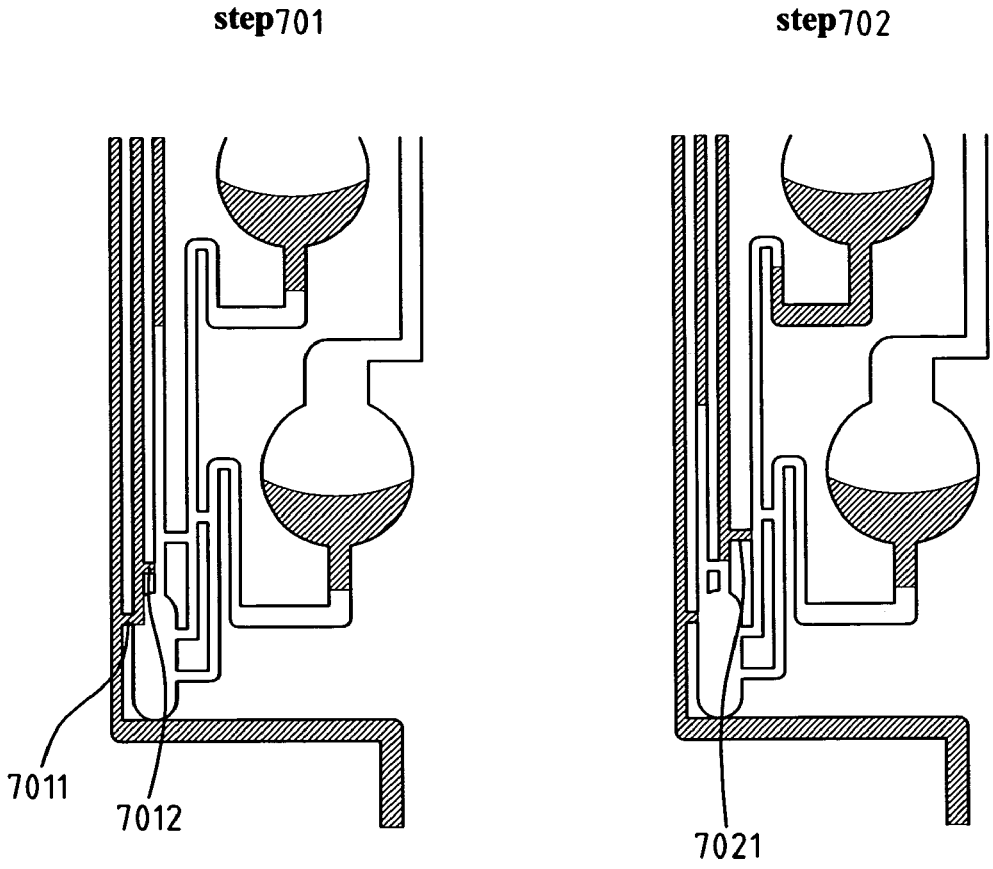
FIG. 7 shows a final flow order control mechanism before the fluid flowing into the collection microchannel.

FIG. 7 shows a final flow order control mechanism before the fluid flowing into the collection microchannel. The fluid, before entering the collection microchannel, will form a horizontal connecting alley at the end of the separate microchannel. As shown in step 701 of FIG. 7, when the first fluid flows and fills the first separate microchannel, the first fluid stops at the mouth of the horizontal connecting alley 7011 connecting the second microchannel due to the surface tension of the fluid. When the second fluid in the neighboring separate microchannel flows down, the second fluid will touch the prior fluid stopped at the mouth of the horizontal connecting alley 7012 and be guided into the collection microchannel. However, if the third fluid in the third separate microchannel is pre-maturely flowing down, the third fluid will be stopped at the mouth of the horizontal connecting alley 7021 due to the surface tension of the fluid, as shown in step 702 of FIG. 7. Therefore, this will further regulate the flow order of the fluids.

An embodiment of the present invention made of PMMA material with the width of the microchannels being within the range of 0.5 mm-1 mm and the depth being 0.5 mm is used to perform the enzyme-linkage immunosorbant assay (ELISA). The embodiment uses five reactant chambers and a PerFluoroChemical FC-70 (density=1.94) is initially placed in the collection microchannel to act as a gravity-driven micropump to provide driving force of the reactants. In the ELISA test, the antigens are immobilized on the inner surface of the microchannels, while the five reactants, including first-degree antibody 50 ul, buffer solution PBS 50 ul, second-degree antibody with enzyme 50 ul, buffer solution PBS 50 ul, and chromogen TMB 50 ul, are placed inside the five reactant chambers, respectively. The total reaction time is about 5 minutes and the test result is correct.

In summary, this invention provides a gravity-driven apparatus and method for flow order control employed in a microfluidic chip. The gravity-driven apparatus comprises a plurality of reactant chambers, a plurality of long and separate microchannels, and a reaction chamber having a long and winding microchannel into which the separate microchannels are converged. It accomplishes the following features: (a) using a geometric structure arrangement for increasing the flow resistance of reactants to enhance the reliability of flow order control for multiple reactants, (b) using a structure of regulating the flow order of the fluids to provide a specified guidance and generate the effect of flow order regulation, (c) using the height change of the present apparatus to activate or stop flow order control, and to adjust the functions of the apparatus, and (d) using the long and separate microchannels as the air vents to lock the flow order and switch direction for the reactants, thereby performing a stable reaction process. It can be built in a microfluidic chip, and does not use any actuating power or element. Therefore, it is low in energy-consumption, low in manufacturing cost and free-of-pollution.

Although the present invention has been- described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A gravity-driven apparatus for controlling the flow order of reactants in a microfluidic device, comprising an elongated flat structure including:

a reaction chamber having a winding collection microchannel;

a plurality of reactant chambers each having an air-in vent and a flow-control microchannel, each flow-control microchannel having at least one section running in the longitudinal direction of the flat structure, each of said reactant chambers being located at a different distance in the longitudinal direction from said winding collection microchannel, and the flow-control microchannels of said plurality of reactant chambers being arranged to converge into said winding collection microchannel; and a plurality of side connection channels each connecting two adjacent flow-control microchannels, said side connection channels running in a direction normal to said longitudinal direction and each being located at a different distance in the longitudinal direction from said winding collection microchannel so that said side connection channels are connected only through corresponding flow-control microchannels;

wherein a plurality of U-shaped structures is formed in said apparatus with each U-shaped structure having a bottom formed by a side connection channel and two arms formed by upper portions of two connected flow-control microchannels, and the U-shaped structures are connected and partially overlapped through flow-control microchannels with the bottoms of the U-shaped structures being located at different distances in the longitudinal direction from said winding collection microchannels for controlling the flow order of reactants.

2. The gravity-driven apparatus for controlling the flow order of reactants in a microfluidic device as claimed in claim 1, wherein the flow-control microchannels of said plurality of reactant chambers have cross-sections with different diameters for providing different flow resistance.

3. The gravity-driven apparatus for controlling the flow order of reactants in a microfluidic device as claimed in claim 1, wherein the flow-control microchannels of said plurality of reactant chambers have different lengths for providing different flow resistance.

4. The gravity-driven apparatus for controlling the flow order of reactants in a microfluidic device as claimed in claim 1, wherein at least one of the flow-control microchannels of said plurality of reactant chambers has at least one bent segment for providing different flow resistance.

5. The gravity-driven apparatus for controlling the flow order of reactants in a microfluidic device as claimed in claim 1, wherein at least one of the flow-control microchannels of said plurality of reactant chambers has at least one bent segment which is bent upwards in the direction opposite to gravity force.

6. The gravity-driven apparatus for controlling the flow order of reactants in a microfluidic device as claimed in claim 1, wherein at least two of the flow-control microchannels of said plurality of reactant chambers have at least one bent segment, and the bent segments have different lengths.

7. The gravity-driven apparatus for controlling the flow order of reactants in a microfluidic device as claimed in claim 1, wherein said gravity-driven apparatus is built in a microfluidic chip.

8. A microfluidic chip comprising the gravity-driven apparatus for controlling the flow order of reactants in a microfluidic device as claimed in claim 1.

* * * * *